United States Patent [19]

Bernard et al.

[11] Patent Number: 4,557,499

[45] Date of Patent: Dec. 10, 1985

[54] REAR ELEMENT FOR A SKI BINDING

[75] Inventors: Jean Bernard; Jean Beyl, both of Nevers; Serge Briée, St Pierre le Moutier; Daniel le Faou, Varennes Vauzelles, all of France

[73] Assignee: Ste LOOK, Nevers, France

[21] Appl. No.: 556,167

[22] Filed: Nov. 29, 1983

[30] Foreign Application Priority Data

Dec. 9, 1982 [FR] France ..... 82 20626

[51] Int. Cl.[4] ..... A63C 9/08

[52] U.S. Cl. ..... 280/626; 206/521; 206/591

[58] Field of Search ..... 280/624, 625, 626, 627, 280/628, 635, 620; 248/316.7; 24/70 SK, 3 J, 3 L; 206/521, 591

[56] References Cited

U.S. PATENT DOCUMENTS

| | | | |
|---|---|---|---|
| 1,795,963 | 3/1931 | Oborski | 24/3 J |
| 3,069,539 | 12/1962 | Kidd | 24/3 J X |
| 3,249,365 | 5/1966 | Beyl | 280/626 |
| 3,752,384 | 8/1973 | Siburn | 206/591 X |
| 3,812,602 | 5/1974 | Gertsch et al. | 280/618 X |
| 4,035,001 | 7/1977 | Jungkind | 280/626 |

FOREIGN PATENT DOCUMENTS

| | | |
|---|---|---|
| 1908159 | 1/1965 | Fed. Rep. of Germany . |
| 1484415 | 5/1967 | France . |

*Primary Examiner*—Joseph F. Peters, Jr.
*Assistant Examiner*—Michael Mar
*Attorney, Agent, or Firm*—Young & Thompson

[57] ABSTRACT

A rear ski-binding element comprises a heel-holding member carried by a plate pivoted about an axis at right angles to the top ski face. Lateral flanges formed on the pivotal plate are each adapted to carry a lateral packing member. Each packing member has a resilient inner wall which is capable of outward elastic deformation under the action of engagement of a ski boot. The rear ski-binding element is thus automatically adaptable to ski boots having different widths.

5 Claims, 5 Drawing Figures

REAR ELEMENT FOR A SKI BINDING

This invention relates to a rear safety ski-binding element of the type comprising a heel-holding member mounted on a plate which is capable of pivotal displacement about an axis at right angles to the top face of the ski.

This type of element, commonly designated as a "rear pivot", is described for example in U.S. Pat. No. 3,249,365.

In a rear pivot, the ski boot is capable of pivotal displacement about a well-defined axis in the vicinity of the axis of the tibia during a lateral disengagement resulting from a fall in twisting motion. By virtue of this arrangement, the torsional stress which develops in the skier's leg during a fall is practically constant, irrespective of the location on the ski of the point of impact which has caused the fall. On the contrary, in the case of a conventional heel-retaining device, the value of this stress which is a function of the point of impact is liable to attain a dangerous level when this point of impact is located in the vicinity of the heel.

At the level of its axis of pivotal motion, a rear pivot comprises a pair of lateral lugs or packing-pieces adapted to cooperate with the sides of the ski-boot sole in order to maintain the boot in its centered position on the ski. The ski-control impulses exerted by the skier are transmitted to the ski by the lateral packing-pieces.

In accordance with standards at present in force, ski boots for adults have a width of 69 mm with a tolerance of ±2 mm, with the result that a difference of 4 mm may be found between the widest and the narrowest ski boots currently available on the market. In order to adapt the lateral packing-pieces to the width of the ski boot, a number of solutions have already been proposed.

Thus in the form of construction described in French Pat. No. 1,484,415, provision is made for packing-pieces or so-called spacer brackets which are adapted to be detachably mounted on the lateral lugs of the pivot. These packing-pieces are made of plastic material and have a slot for positioning on the lugs by resilient snap-action engagement. The packing-pieces have a different thickness on each side of the slot. By positioning or removing one or both of the packing-pieces and by changing their direction of assembly, six different ski-boot widths can thus be accommodated.

Another known form of construction disclosed, for example, in German utility Pat. No. 1,908,159 consists of a rear pivot which is adapted to the ski-boot width by operation of an adjusting screw.

As far as skiers are concerned, these known systems have provided generally satisfactory. Nevertheless, skiing equipment dealers or hirers who have the task of fitting and carrying out various adjustments on ski bindings for their customers have found that the known systems represent additional labor which is not encountered in the case of conventional heel-retaining devices. For simple practical reasons and especially during busy periods, an equipment dealer is consequently often inclined to advise his customers to buy or hire more conventional equipment without giving due consideration to the safety factor whereas this should precisely be a decisive factor in the choice of equipment.

Furthermore, however simple it may be, the width adjustment system is clearly a cause of complexity and of additional cost of the ski binding.

The object of the present invention is to overcome these disadvantages and is therefore concerned with a rear pivot which is automatically adapted to the width of the ski boot as this latter is being engaged within the ski binding.

This result is obtained by means of lateral packing members provided in at least one and preferably both cases with an inner wall which is elastically deformable away from the ski in the outward direction. These lateral packing members are so designed that the initial relative spacing of their inner walls should correspond to the minimum possible width of the ski boot. The introduction of a ski boot of greater width between the packing members causes outward deformation of the resilient inner wall or walls away from the ski until the relative spacing of the walls corresponds to the effective width of the ski boot.

Other features of the invention will be more apparent to those versed in the art upon consideration of the following description and accompanying drawings, wherein.

Figure 1:
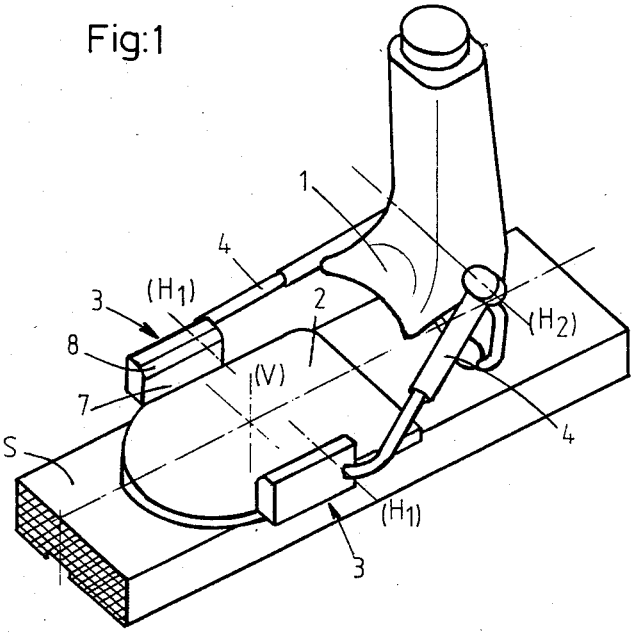
FIG. 1 is a schematic view in perspective showing a rear pivot in accordance with the invention and mounted on a ski.

The rear pivot illustrated in FIG. 1 comprises a heel-holding member 1 mounted on a pivotal plate 2. The plate 2 is mounted on the top face of the ski S in such a manner as to be capable of rotating about an axis V at right angles to said top face. The plate 2 is adapted to carry a pair of lateral packing members 3 in which are mounted arms 4, said arms being capable of pivoting about transverse axes (H1) parallel to the top face of the ski. The heel-holding member 1 is in turn pivotally mounted on the arms 4 so as to be capable of rotating about a transverse axis (H2) which is parallel to the top face of the ski. The operation of this safety device will not be explained here for the sake of simplification since it does not bear any relation to the invention proper and is any case fully described in U.S. Pat. No. 3,249,365 cited earlier.

Figure 2:
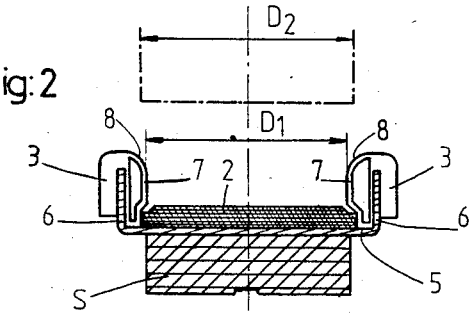
FIGS. 2 and 3 are transverse sectional views of a first embodment of the lateral packing members in accordance with the invention, respectively before and after positioning of the boot on the ski.

FIG. 2 shows the pivotal plate 2 which is intended to serve as a support for the rear portion of the ski boot. The plate consists of an element of plastic material carried by a metallic sub-plate 5. The sub-plate is retained and guided on the ski so as to be capable of rotating about the axis (V) by virtue of means which have not been illustrated for enhanced simplicity. The sub-plate 5 is provided with a pair of vertical flanges 6 which project laterally and upwards from the edges of the ski. The lateral packing members 3 are fixed on the flanges 6 by any suitable method within the capacity of those skilled in the art such as, for example, by overmolding or by resilient snap-action engagement. Each member 3 has an inner wall 7 in the form of a partition which is joined to the remainder of the packing member at the upper and lower ends of this latter. The entire packing member 3 including the inner wall 7 is formed in a single piece and molded from resilient plastic material such as polyurethane, for example.

The inner walls or partitions 7 are relatively spaced at a distance D1 equal to the minimum possible width of a ski boot, namely 67 mm in the case of a boot for adults.

Figure 3:
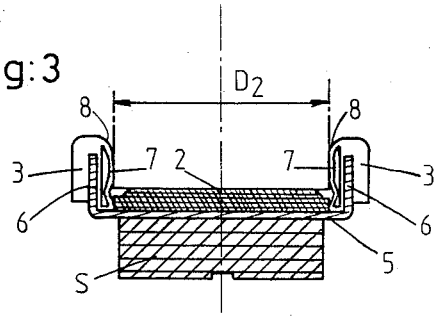

If the ski boot does in fact have this width, positioning of the boot within the binding clearly does not give rise to any difficulties since the boot fits exactly between the packing members 3. If, on the contrary, the ski boot C has a width D2 greater than the distance D1, the introduction of the ski-boot sole between the packing members at the time of engagement of the boot within the ski binding has the effect of moving the partition-walls 7 away from each other. The partition-walls are thus thrust outwards with respect to the ski and adapt automatically to the width D2 (as shown in FIG. 3).

It will be noted that the top inner edge 8 of the packing members 3 is rounded and flared-out in order to facilitate the introduction of the ski boot.

Figure 4:
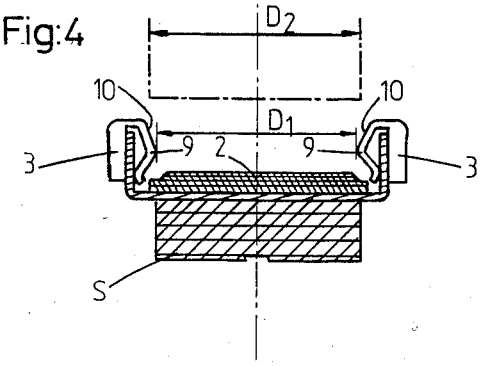
FIGS. 4 and 5 are views which are similar to FIGS. 2 and 3 respectively and show a second embodiment.
Figure 5:
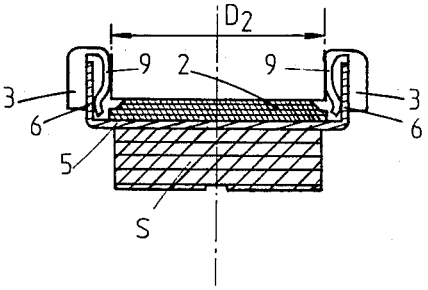

The second embodiment illustrated in FIGS. 4 and 5 is similar to the form of construction described in the foregoing except for the inner wall of each lateral packing member 3. This inner wall is designed in the form of a resilient tongue 9 which is joined to the remainder of the packing member solely at the top. The tongue has a cross-section of elbowed shape, thus constituting a beveled entrance surface 10 for rapid engagement of the ski boot. The tongue can be molded with the packing member of plastic material 3 or can alternatively constitute an added part. Thus the tongue 9 could be a spring-steel blade riveted to the packing member 3.

When a ski boot C is introduced into a ski binding and the sole of the boot has a width D2 which exceeds the initial relative spacing D1 of the packingmember tongues, the boot causes elastic deformation of the tongues away from the ski in the outward direction and consequently produces automatic adaptation of said tongues to the width of the ski boot (as shown in FIG. 5).

As will readily be understood, the resilient inner walls 7 or 9 must be sufficiently flexible to permit easy positioning of the boot within the ski binding without hindering any subsequent release of the boot in the event of a forward fall and without disturbing the operation of the safety mechanism housed within the heel-holding member 1. However, the resilient inner walls must have a sufficient degree of stiffness to retain the ski boot correctly in the transverse direction since any side-slip would be liable to impair the accuracy of ski control.

It sill be noted that the resilient packing members in accordance with the invention are extremely simple and inexpensive to produce. Since adjustment for width of ski boots is no longer necessary, the packing members enable ski retailers or hirers to achieve a considerable saving of time.

Without departing from the scope of the invention, it would be possible to reduce the cost price of the ski binding even further by making provision for elastic deformation of only one of the two packing members. However, this restriction is subject to the disadvantage of displacing the ski boot with respect to the longitudinal axis of the ski and even more so as the boot is of greater width. A lateral displacement of the ski boot is not advisable, especially in the case of skiers who have reached a high standard of proficiency.

What is claimed is:

1. A rear ski-binding element comprising a heel-holding member carried by a plate pivoted about an axis at right angles to the top ski face, and a pair of lateral packing members also carried by said plate, said lateral packing members being adapted to cooperate with the sides of the ski boot in order to maintain said boot centered on the ski, wherein each of said packing members has a resilient inner wall which is capable of elastic deformation away from the ski in an outward direction in order to adapt automatically to the width of the ski boot, the inner wall forming an integral part of the packing member, the upper portion of the inner wall extending inwardly and downwardly in order to facilitate positioning of the boot on the ski.

2. A rear ski-binding element according to claim 1, wherein the inner wall is designed in the form of a partition of small thickness whose upper and lower ends are joined to the packing member.

3. A rear ski-binding element according to claim 1, wherein the inner wall is designed in the form of a resilient tongue whose upper end is joined to the packing member.

4. A rear ski-binding element according to claim 1, wherein the packing member and the inner wall are formed of molded plastic material such as polyurethane.

5. A rear ski-binding element according to claim 1, wherein said packing members are elongated in the direction of the ski and said inner wall extends substantially the full length of said at least one packing member.

* * * * *